US006748620B2

(12) United States Patent
Ching-Chen

(10) Patent No.: US 6,748,620 B2
(45) Date of Patent: Jun. 15, 2004

(54) CLEANING BRUSH WITH WATER-MAINTAINING EFFECT

(76) Inventor: Chen Ching-Chen, No.80-2, Wung-Yuann Rd., Pei-Dou Cheng, Chang-Hau Hsien (TW)

( * ) Notice: Subject to any disclaimer, the term of this patent is extended or adjusted under 35 U.S.C. 154(b) by 228 days.

(21) Appl. No.: 10/043,316

(22) Filed: Jan. 14, 2002

(65) Prior Publication Data

US 2003/0131429 A1 Jul. 17, 2003

(51) Int. Cl.[7] ..... A47K 7/02

(52) U.S. Cl. ..... 15/110; 15/114; 15/118; 15/209.1; 15/229.11; 15/244.1; 601/134; 601/135; 601/137; D28/63

(58) Field of Search ..... 15/110, 114, 118, 15/209.1, 229.11, 229.12, 229.13, 244.1, 244.3, 244.4; 601/134–138; D28/63

(56) References Cited

U.S. PATENT DOCUMENTS 1,950,318 A * 3/1934 McNab ..... 15/110 X
D189,415 S * 12/1960 Arrix ..... D28/63
5,531,666 A * 7/1996 Hung ..... 601/135 X
5,758,386 A 6/1998 Chen ..... 15/229.11
5,787,542 A * 8/1998 Chien ..... 15/244.3
5,983,435 A * 11/1999 Osborne ..... 15/209.1
6,276,024 B1 * 8/2001 Galvan-Garza ..... 15/244.4
6,370,723 B1 * 4/2002 Chang ..... 15/110
6,510,577 B1 * 1/2003 Borcherds et al. ..... 15/118

* cited by examiner

*Primary Examiner*—Mark Spisich
(74) *Attorney, Agent, or Firm*—Dennison, Schultz, Dougherty & MacDonald

(57) ABSTRACT

Cleaning brush with water-maintaining effect, including: a resilient main body having a neck section, a first expanding section formed on upper side of the neck section and a second expanding section formed on lower side of the neck section; and a fitting member made of water-absorbent material and having an opening. The fitting member is fitted around the first expanding section to tightly enclose a predetermined portion of the first expanding section. The water-absorbent fitting member is able to maintain the water contained in the first expanding section and the fitting member. The cleaning brush is designed with various patterns and also has massaging effect.

5 Claims, 3 Drawing Sheets

CLEANING BRUSH WITH WATER-MAINTAINING EFFECT

BACKGROUND OF THE INVENTION

The present invention is related to a cleaning brush, and more particularly to a cleaning brush for cleaning human skin. The cleaning brush has water-maintaining effect and is designed with various patterns.

U.S. Pat. No. 5,758,386 of this applicant discloses a cleaning brush structure which includes a main body made of resilient mesh tube having a neck section. The upper side of the neck section is formed with a first expanding section, while the lower side of the neck section is formed with a second expanding section. Such structure is like two overlapping spherical bodies and can be easily held when used. However, when holding the first expanding section to rub a user's body with the second expanding section, the second expanding section will uncertainly deflect around about the neck section. Furthermore, such structure is too compact and the expanding sections are too regularly shaped so that it is hard to snugly attach the structure to the skin and the user may feel uncomfortable when using the cleaning brush. Such structure is unable to maintain water. After a period of use, it is necessary to again dip the bathing ball into water. Moreover, when a bathing cream is also used to clean the skin, such structure is unable to maintain water so that when rubbing the skin with the bathing ball, it is hard to create lathers.

SUMMARY OF THE INVENTION

It is therefore a primary object of the present invention to provide a cleaning brush having simple structure and water-maintaining effect.

It is a further object of the present invention to provide the above cleaning brush which is designed with various patterns and also has massaging effect.

According to the above objects, the cleaning brush with water-maintaining effect of the present invention includes: a resilient main body having a neck section, a first expanding section formed on upper side of the neck section and a second expanding section formed on lower side of the neck section; and a fitting member made of water-absorbent material and having an opening. The fitting member is fitted around the first expanding section to tightly enclose a predetermined portion of the first expanding section. The water-absorbent fitting member is able to maintain the water contained in the first expanding section and the fitting member.

The present invention can be best understood through the following description and accompanying drawings wherein:

DETAILED DESCRIPTION OF THE PREFERRED EMBODIMENTS

Figure 1:
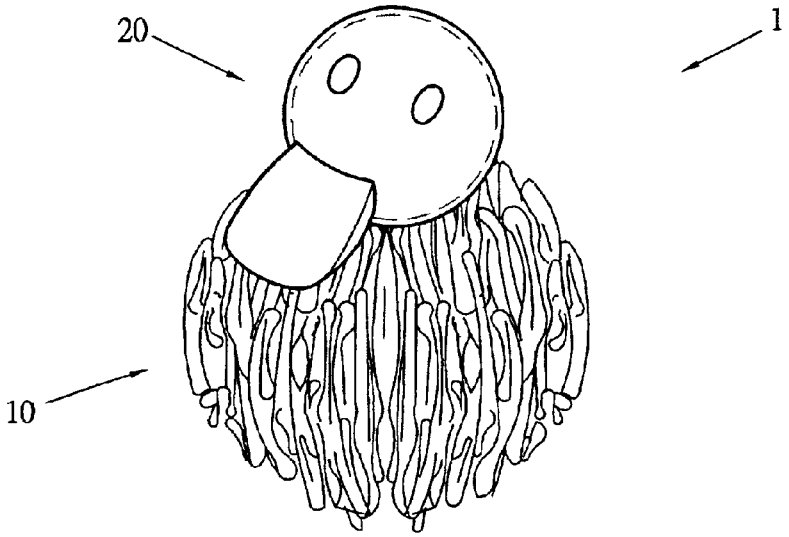
FIG. 1 is a perspective assembled view of a preferred embodiment of the cleaning brush of the present invention.
Figure 2:
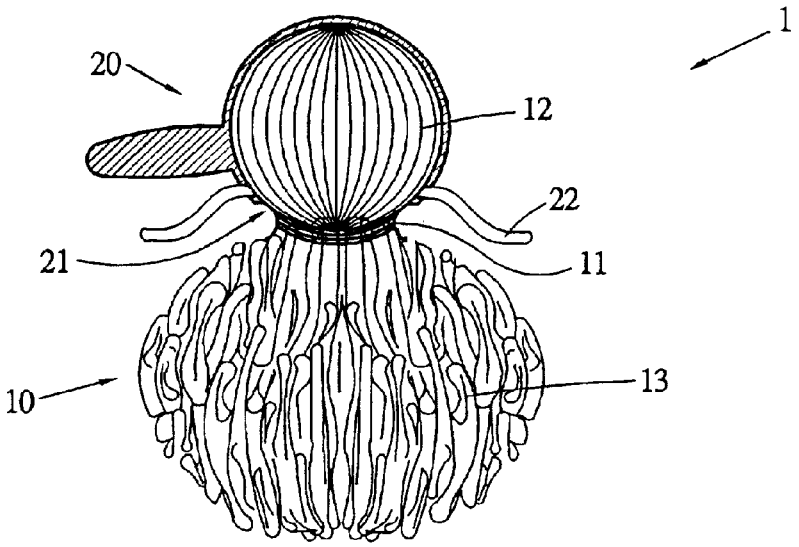
FIG. 2 is a plane sectional view of the preferred embodiment of the cleaning brush of the present invention.

Please refer to FIGS. 1 and 2. The cleaning brush with water-maintaining effect of the present invention includes a resilient main body 10 and a fitting member 20 fitted on the main body 10.

The main body 10 is made of a mesh tube with a certain length and resilience. When manufactured, the mesh tube is axially compressed to crimp the periphery. Predetermined portions of the mesh tube are then bound and fixed by several binding members to form a neck section 11. The upper end of the neck section 11 is formed with a first expanding section 12, while the lower end of the neck section 11 is formed with a second expanding section 13. The first expanding section 12 regularly expands and has a form of a sphere about an axis. The second expanding section 13 freely expands and is irregularly waved and petal-shaped. Practically, the resilient main body 10 can be composed of at least two mesh tubes serially connected or fitted with each other.

The fitting member 20 is a casing having a predetermined thickness and an opening 21. The casing is made of water-absorbent material such as sponge, cotton fabric and unwoven fabric. The casing can be designed with various patterns.

When assembled, the first expanding section 12 is fitted through the opening 21 into the fitting member 20. The fitting member 20 tightly encloses the first expanding section 12. A binding member 22 is used to tightly bind the opening 21 on the neck section 11 without detachment. After the cleaning brush 1 is wetted, a certain amount of water is confined in the fitting member 20 so as to prolong the losing time of the water. In addition, the fitting member 20 itself has water-absorption function so that the cleaning brush 1 can have better water-maintaining effect. The casing 20 can be designed with various patterns so as to attract consumers.

Figure 3:
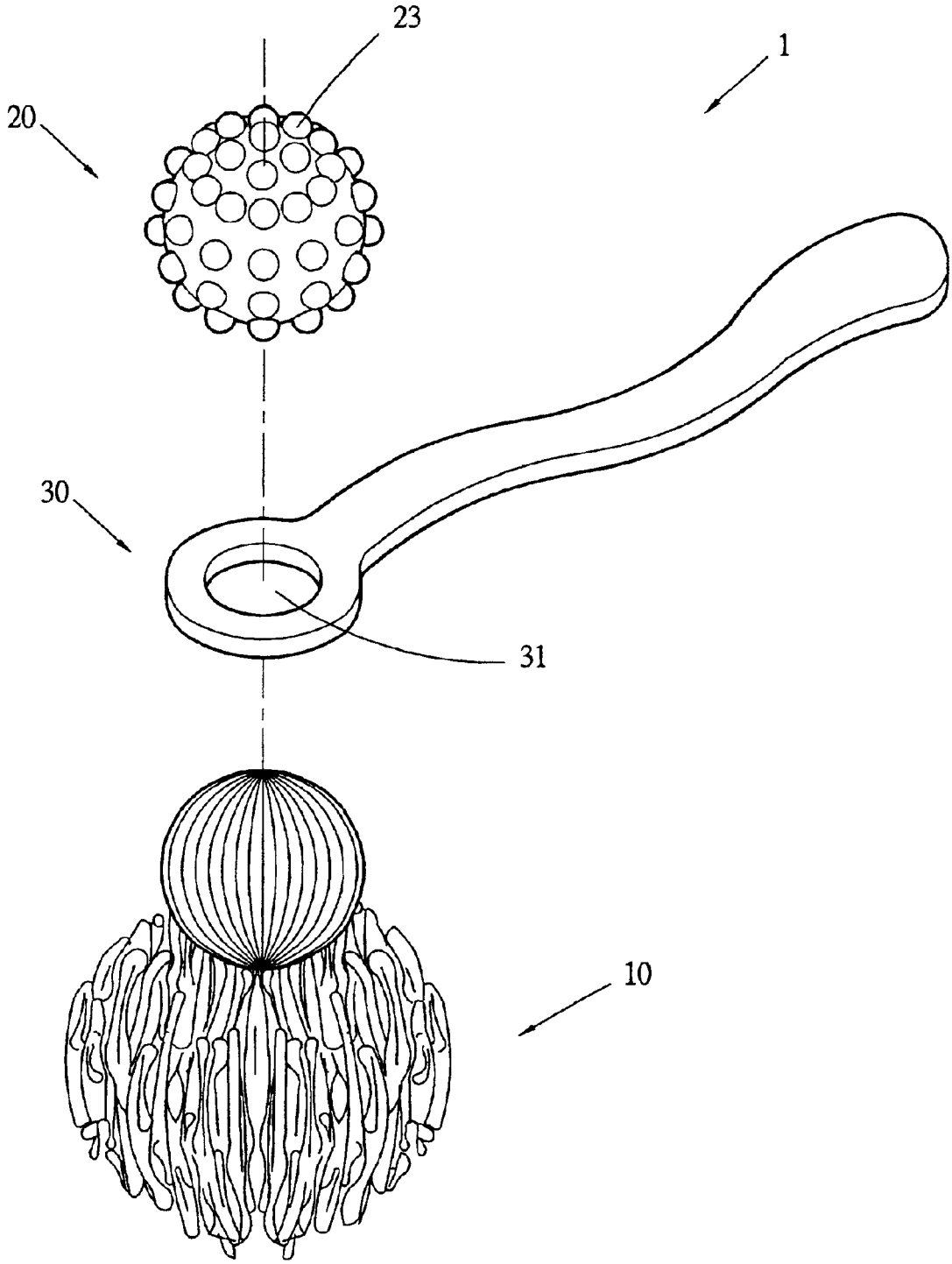
FIG. 3 is a perspective exploded view of another embodiment of the cleaning brush of the present invention.

FIG. 3 shows another embodiment of the cleaning brush 1 of the present invention, in which the fitting member 20 is made of elastic material such as rubber and foam sponge. Multiple protuberances 23 are formed over the outer face of the fitting member 20. The cleaning brush 1 further includes a handle 30 formed with a through hole 31 in a predetermined position. When assembled, the first expanding section 12 is compressed to pass through the through hole 31, whereby the handle 30 is fitted around the neck section 11 of the resilient main body 10. Under such circumstance, the first and second expanding sections 12, 13 are respectively positioned on upper and lower sides of the through hole 31. Then, as in the above embodiment, the fitting member 20 is fitted on the first expanding section 12. The fitting member 20 is formed with the protuberances 23, whereby a user can knock a part of his/her body with the fitting member 20 so as to massage the part. Alternatively, the user can press the fitting member 20 against a part of his/her body and rub and massage the part. The protuberances 23 contact with the skin at points so as to achieve massaging effect.

Figure 4:
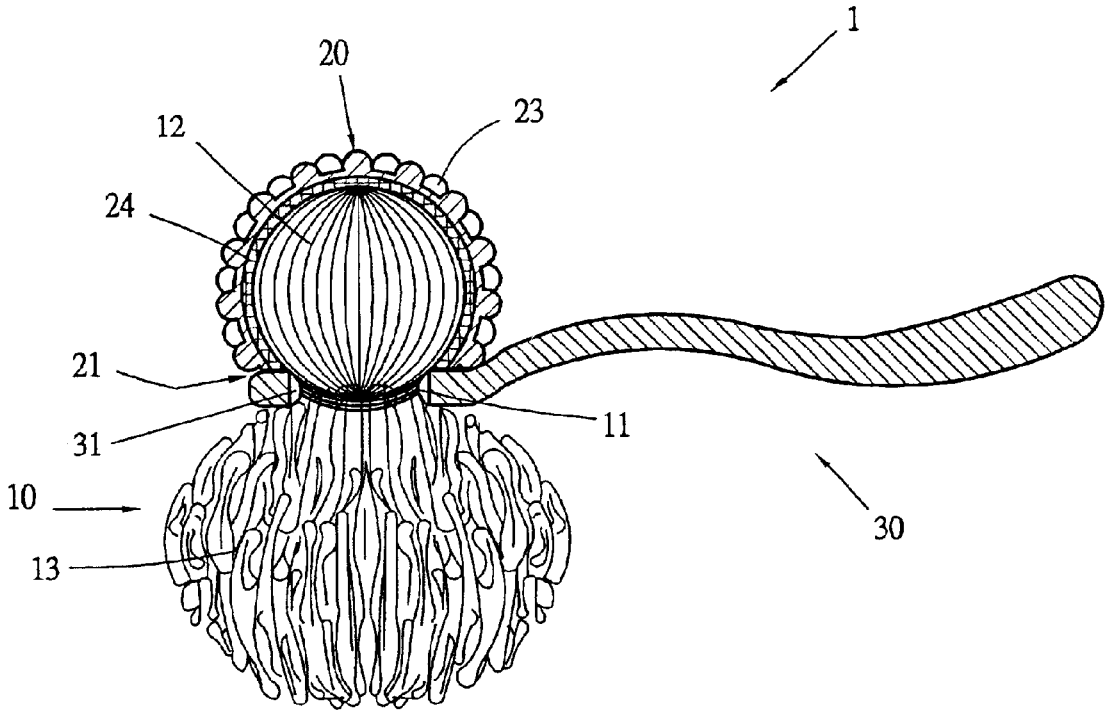
FIG. 4 is a plane sectional view of still another embodiment of the cleaning brush of the present invention.

FIG. 4 shows still another embodiment of the present invention, in which a water-absorbent layer 24 is additionally disposed on inner face of the fitting member 20. The water-absorbent layer 24 is made of water-absorbent material such as sponge, cotton fabric and unwoven fabric. When assembled, the water-absorbent layer 24 is first placed between the first expanding section 12 and the inner face of the fitting member 20 to tightly enclose the first expanding section 12. Accordingly, the fitting member 20 can be made of a material without water-absorbent effect. By means of the water-absorbent layer 24, a water-maintaining effect can be still achieved.

According to the above arrangement, the cleaning brush of the present invention has the following advantages:

1. The cleaning brush of the present invention is able to prolong the losing time of water so as to achieve water-maintaining effect. When using a bathing cream to clean human body, with the cleaning brush, it is easier to rub a user's body to create lathers. It is unnecessary to many times dip the cleaning brush into water so that it is convenient to use the cleaning brush.

2. The cleaning brush of the present invention is designed with various patterns so as to attract consumers. Moreover, the cleaning brush also has massaging effect.

The above embodiments are only used to illustrate the present invention, not intended to limit the scope thereof. Many modifications of the above embodiments can be made without departing from the spirit of the present invention.

What is claimed is:

1. A cleaning brush with water-maintaining effect, comprising:

a resilient main body having a neck section, a first expanding section formed on an upper side of the neck section and a second expanding section formed on a lower side of the neck section; and a fitting member made of water-absorbent material and having an opening, the fitting member being fitted around the first expanding section to enclose a predetermined portion of the first expanding section, whereby the water-absorbent fitting member is able to slow down the losing rate of the water contained in the first expanding section and the fitting member;

a binding member for binding the opening of the fitting member;

and further comprising a handle formed with a through hole in a predetermined position, the neck section of the resilient main body being fitted in the through hole, whereby the first and second expanding sections are respectively positioned on upper and lower sides of the through hole.

2. A cleaning brush with water-maintaining effect, comprising:

a resilient main body having a neck section, a first expanding section formed on an upper side of the neck section and a second expanding section formed on a lower side of the neck section; and a fitting member made of elastic material and having an opening, the fitting member being fitted around the first expanding section to enclose a predetermined portion of the first expanding section, multiple protuberances being formed over an outer face of the fitting member, wherein a water-absorbent layer is additionally disposed on an inner face of the fitting member, the water-absorbent layer being made of water-absorbent material, and wherein the resilient main body is made of resilient mesh tube material with a predetermined length.

3. A cleaning brush with water-maintaining effect, comprising:

a resilient main body having a neck section, a first expanding section formed on an upper side of the neck section and a second expanding section formed on a lower side of the neck section; and a fitting member made of elastic material and having an opening, the fitting member being fitted around the first expanding section to enclose a predetermined portion of the first expanding section, multiple protuberances being formed over an outer face of the fitting member, wherein the resilient main body is made of resilient mesh tube material with a predetermined length, said cleaning brush further comprising a handle formed with a through hole in a predetermined position, the neck section of the resilient main body being fitted in the through hole, whereby the first and second expanding sections are respectively positioned on upper and lower sides of the through hole.

4. A cleaning brush with water-maintaining effect as called for in claim 3, wherein a water-absorbent layer is additionally disposed on an inner face of the fitting member, the water-absorbent layer being made of water-absorbent material, and wherein the second expanding section freely expands and is petal-shaped.

5. A cleaning brush with water-maintaining effect as called for in claim 3, wherein a water-absorbent layer is additionally disposed on an inner face of the fitting member, the water-absorbent layer being made of water-absorbent material, wherein the first expanding section regularly expands and has a shape with the neck section as an axis.

* * * * *